US007309308B2

(12) United States Patent
Berger et al.

(10) Patent No.: US 7,309,308 B2
(45) Date of Patent: Dec. 18, 2007

(54) CENTRIFUGAL OIL SEPARATOR IN AN INTERNAL COMBUSTION ENGINE

(75) Inventors: Alexander Berger, Rechberghausen (DE); Roland Nöll, Esslingen (DE); Christoph Reckzugel, Hohenstadt (DE); Timo Schmidt, Stuttgart (DE)

(73) Assignee: DaimlerChrysler AG, Stuttgart (DE)

( * ) Notice: Subject to any disclaimer, the term of this patent is extended or adjusted under 35 U.S.C. 154(b) by 532 days.

(21) Appl. No.: 11/010,837

(22) Filed: Dec. 13, 2004

(65) Prior Publication Data

US 2005/0121262 A1 Jun. 9, 2005

Related U.S. Application Data

(63) Continuation-in-part of application No. PCT/EP03/04308, filed on Apr. 25, 2003.

(30) Foreign Application Priority Data

Jun. 15, 2002 (DE) ..... 102 26 695

(51) Int. Cl.
*F01M 13/04* (2006.01)

(52) U.S. Cl. ..... 494/81; 494/43; 210/232; 210/167.01; 210/171; 210/360.1; 210/380.1; 184/6.24; 123/572; 123/573; 55/385.3; 55/385.4; 55/400

(58) Field of Classification Search ..... 494/43, 494/81; 210/232, 167.01, 171, 360.1, 380.1; 184/6.24; 123/572, 573; 55/385.3, 385.4, 55/400, DIG. 19

See application file for complete search history.

(56) References Cited

U.S. PATENT DOCUMENTS

| | | | | |
|---|---|---|---|---|
| 5,954,035 | A * | 9/1999 | Hofer et al. | 123/573 |
| 6,814,768 | B2 * | 11/2004 | Keller | 55/400 |
| 2001/0016549 | A1 * | 8/2001 | Herman et al. | 494/49 |

FOREIGN PATENT DOCUMENTS

| | | |
|---|---|---|
| DE | 36 19 926 | 1/1987 |
| DE | 196 07 919 | 9/1997 |
| DE | 197 15 661 | 10/1998 |
| DE | 199 47 143 C1 | 4/2001 |
| DE | 101 40 301 | 2/2003 |
| GB | 7 09 646 | 6/1954 |
| JP | 04-153514 | 5/1992 |

OTHER PUBLICATIONS

XP000932181 Neuz Ölzentrifugeaus Kunstsloff in Spritz gusstechnik, MTZ Motor technische Zeitschrift 61 (2000) 5.

* cited by examiner

*Primary Examiner*—David A Reifsnyder
(74) *Attorney, Agent, or Firm*—Klaus J. Bach

(57) ABSTRACT

In a centrifugal oil separator in an internal combustion engine including a centrifuge housing which is placed in a rotationally fixed manner onto a rotating centrifuge shaft, the centrifuge housing is manufactured from plastic and a metal bushing is integrated into the centrifuge housing and is slipped onto the centrifuge shaft.

10 Claims, 2 Drawing Sheets

CENTRIFUGAL OIL SEPARATOR IN AN INTERNAL COMBUSTION ENGINE

This is a Continuation-In-Part Application of International application PCT/EP03/04308 filed Apr. 25, 2003 and claiming the priority of German application 102 26 695.6 filed Jun. 15, 2002.

BACKGROUND OF THE INVENTION

The invention relates to a centrifugal oil separator in an internal combustion engine including a centrifuge housing.

Such a centrifugal oil separator is described, for example, in DE 196 07 919 A1. This oil separator can be used to separate oil particles in an oil/air mixture in a crankcase of an internal combustion engine and to return the oil to the oil sump. The centrifugal oil separator makes use of rotation generating centrifugal forces to separate the oil particles from the mixture and conduct the oil away. The oil separator has a centrifuge housing including a separating space in which baffles are arranged for collecting the oil particles. The oil collected is removed radially and the cleaned air is conducted away axially via an outflow passage in the centrifuge shaft.

Such oil separators should be easy to install. Also, a secure seat on the centrifuge shaft should be established. In the known oil separators, the centrifuge housing is usually flange-mounted and screwed onto a shaft driven by the internal combustion engine. However, this involves relatively high installation expenses.

It is the object of the present invention to provide an arrangement by which installation of centrifugal oil separators is facilitated. In addition, a long service life of the oil separator is to be ensured.

SUMMARY OF THE INVENTION

In a centrifugal oil separator in an internal combustion engine, wherein the oil separator includes a centrifuge housing which is disposed in a rotationally fixed manner on a rotating centrifuge shaft, the centrifuge housing is manufactured from plastic and a metal bushing is integrated into the centrifuge housing and is slipped onto the centrifuge shaft.

The centrifuge housing and the metal bushing form a pre-manufactured unit which is slipped onto the shaft and is connected to the latter. The metal bushing is capable of transmitting high retaining forces, with the result that a secure fastening on the centrifuge shaft is possible. The plastic centrifuge housing is distinguished by a low weight, resulting in relatively low centrifugal forces in the housing wall during rotation of the oil separator.

For easier installation, the metal bushing can be slipped onto the centrifuge shaft with little play; forces which occur during the operation are readily accommodated by the metal bushing and the centrifuge housing is not subjected to these forces, as a result of which improved rotatability and a longer service life are ensured.

In one expedient embodiment, the centrifuge shaft is a separate component which is connected in a rotationally fixed manner to a rotating shaft of the internal combustion engine—for example the camshaft, the crankshaft or a balance shaft. In this embodiment, the centrifugal oil separator together with the separate centrifuge shaft can form a preassembled unit, which is inserted into the internal combustion engine and is connected to the latter. It has proved expedient to connect the oil separator to a chain wheel, the centrifuge shaft being inserted into a recess in the chain wheel, in particular being inserted into the recess in the chain wheel so as to form a press fit. Additional connecting measures between the oil separator and the shaft can therefore in principle be omitted.

An air space can be formed between a side wall of the centrifuge housing and the chain wheel, in particular in an airtight and pressure tight manner, said space serving to conduct away the clean air after removal of the oil. The air space advantageously annularly surrounds the centrifuge shaft which communicates with the air space via radial openings through which the clean air can flow radially inward into a flow passage extending axially in the centrifuge shaft. The clean air can be removed from the oil separator via the axial flow passage.

For a firm connection between the metal bushing and the centrifuge housing, it may be expedient for the metal bushing to be molded into the spinning wheel.

In order to axially secure the metal bushing against an unintentional release from the centrifuge shaft, a securing ring may be mounted onto the shaft. However, a groove nut which is screwed against the metal bushing is also suitable.

The invention will become more readily apparent form the following description thereof on the basis of the accompanying drawings:

DESCRIPTION OF PREFERRED EMBODIMENTS

Figure 1:
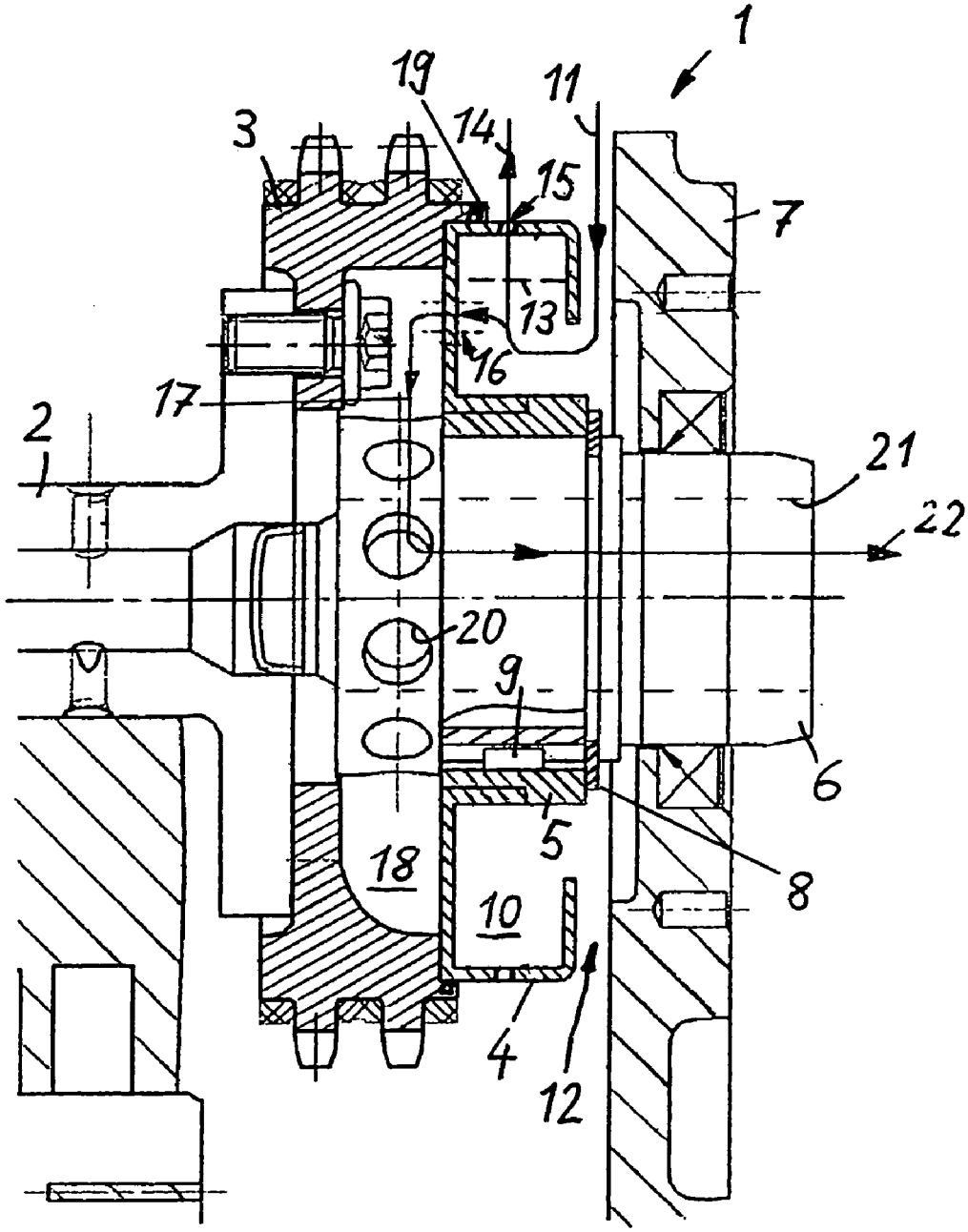
FIG. 1 shows a section through a centrifugal oil separator in the crankcase of an internal combustion engine, which centrifugal oil separator is mounted onto a chain wheel connected in a rotationally fixed manner to a camshaft.

In the following figures, identical components are designated by the same reference numerals.

The centrifugal oil separator 1 which is illustrated in FIG. 1 is connected in a rotationally fixed manner to a camshaft 2 of an internal combustion engine and is arranged at an end face of a chain wheel 3 which is flange-mounted onto the camshaft 2 for rotation therewith. The oil separator 1 comprises a centrifuge housing 4 which is manufactured from plastic, and a metal bushing 5 which is integrated into the centrifuge housing 4 and forms the hub of the centrifuge housing. Furthermore, the oil separator 1 comprises a centrifuge shaft 6 which is inserted into the metal bushing 5.

The metal bushing 5 is secured both in the circumferential direction and also axially against being unintentionally released from the centrifuge shaft 6. A securing ring 8 is provided for the axial securing, which ring can be inserted into an encircling groove on the centrifuge shaft 6 and is thereby secured for its part against being lost axially. The centrifuge shaft 6 is carried along in the circumferential direction via a form-fitting element 9 which is arranged radially between the centrifuge shaft 6 and metal bushing 5.

The centrifuge shaft 6 is designed as a separate component independent of the camshaft 2. For the connection between the oil separator 1 and camshaft 2, the centrifuge shaft 6 is inserted into an axial recess in the chain wheel 3, in particular is inserted under pressure, with, if appropriate, also additional or alternative fastening means being provided.

On the side facing away from the chain wheel 3, the oil separator 1 has an oil separator cover 7 which likewise is supported on the centrifuge shaft 6. The oil separator cover 7 forms part of the oil separator 1 and, in the same manner as the centrifuge housing 4, the metal bushing 5 and the centrifuge shaft 6, can be assembled to form a pre-manufactured unit.

A separating space 10 is formed in the centrifuge housing 4, which separating space extends annularly around the metal bushing 5 and in which the air/oil mixture flowing radially according to arrow 11 into the housing is separated into its constituents of oil and air. The air/oil mixture enters via a radial inflow passage 12 which is formed between an end face of the centrifuge housing 4 and the oil separator cover 7. Via an axial annular opening, the mixture flows into the separating space 10 in which baffles 13 are provided for assisting the separation of the oil. The separated oil is conducted away radially according to arrow 14 through outflow openings 15 in the circumferential wall of the centrifuge housing 4.

The clean air leaves the separating space 10 via axial outflow openings 16 in a side wall of the centrifuge housing 4, which wall faces the chain wheel 3, and flows first into an annular air space 18 which is situated in an end-face recess of the chain wheel 3 and is bounded axially by a wall of the centrifuge housing 4 and radially inwardly by the centrifuge shaft 6. The air space 18 is sealed off from the surroundings in particular in an airtight and pressure-tight manner. To assist the sealing, a sealing ring 19 is provided between the centrifuge housing 4 and chain wheel 3.

The air space 18 annularly surrounds the centrifuge shaft 6 and communicates via radial holes 20 in the wall of the centrifuge shaft 6 with an axially extending flow passage 21 in the interior of the centrifuge shaft 6. The clean air is guided out of the air space 18 in the direction of the arrow 17 to the radial holes 20 and then radially inward through the latter and is finally conducted away from the oil separator 1 axially in the arrow direction 22 via the flow passage 21.

Figure 2:
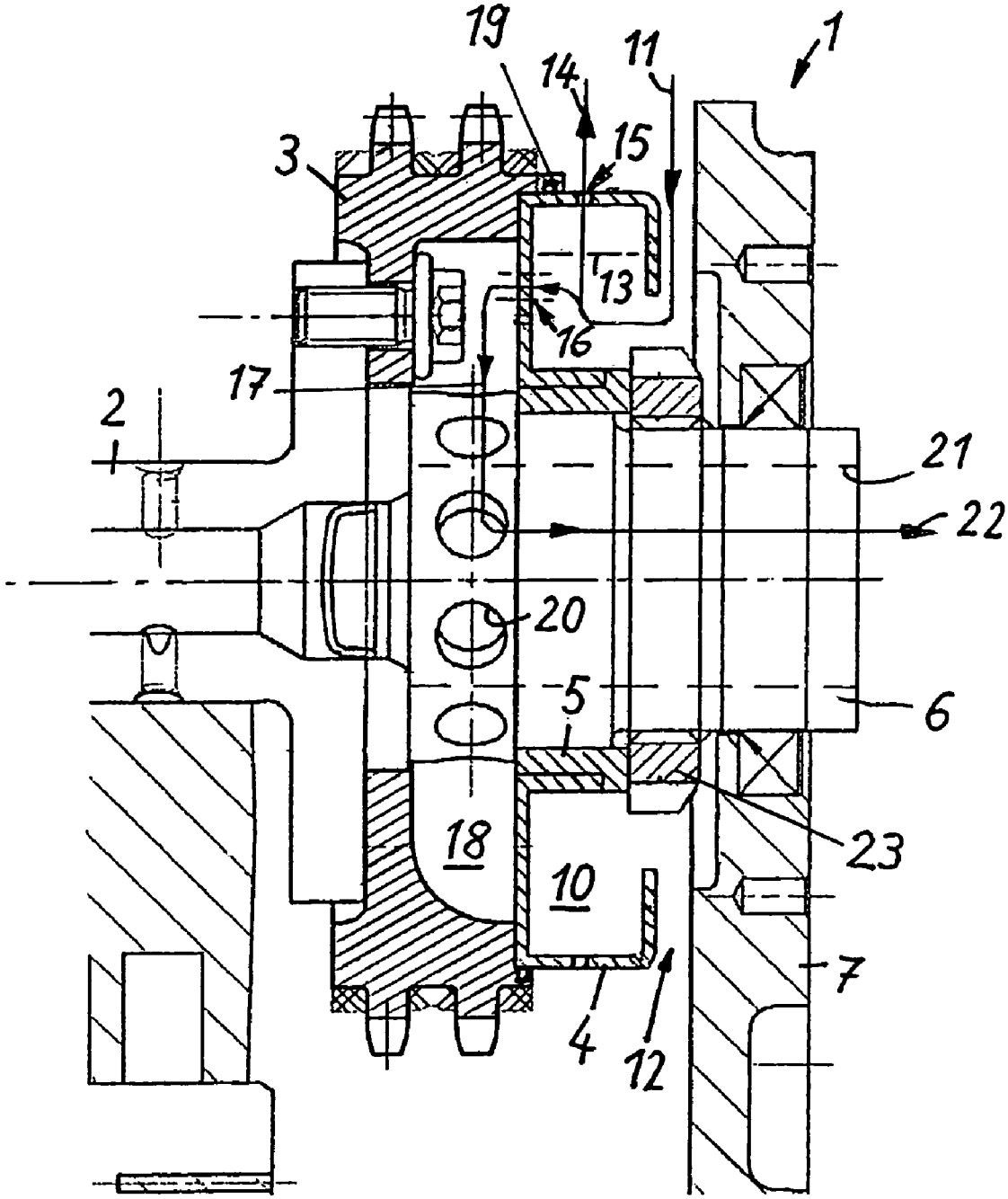
FIG. 2 shows another embodiment of the oil separator.

The construction of the oil separator 1 according to FIG. 2 corresponds in principle to that of the previous exemplary embodiment, but with the difference that, in order to axially secure the metal bushing 5 and centrifuge housing 4 on the centrifuge shaft 6, a groove nut 23 is screwed onto the shaft 6.

What is claimed is:

1. A centrifugal oil separator in an internal combustion engine, having a centrifuge housing of a plastic material (4) mounted onto a rotating centrifuge shaft (6) for rotation therewith, and a metal bushing (5) integrated into the centrifuge housing (4) and slipped onto the centrifuge shaft (6).

2. The centrifugal oil separator as claimed in claim 1, wherein the centrifuge shaft (6) is a separate component which is connected in a rotationally fixed manner to a rotating shaft (2) of the internal combustion engine.

3. The centrifugal oil separator as claimed in claim 2, wherein the centrifuge housing (4) is disposed axially adjacent a chain wheel (3) which rotates together with the rotating shaft (2).

4. The centrifugal oil separator as claimed in claim 3, wherein an air space (18) for conducting away clean air is formed between a side wall of the centrifuge housing (4) and the chain wheel (3).

5. The centrifugal oil separator as claimed in claim 2, wherein the centrifuge shaft (6) is inserted into a recess in the chain wheel (3).

6. The centrifugal oil separator as claimed in claim 1, wherein the centrifuge shaft (6) has radial openings (20) for conducting clean air radially inwardly into the centrifuge shaft (6).

7. The centrifugal oil separator as claimed in claim 1, wherein the centrifuge shaft (6) has an axial flow passage (21) for conducting away clean air.

8. The centrifugal oil separator as claimed in claim 1, wherein the metal bushing (5) is molded into the centrifuge housing (4).

9. The centrifugal oil separator as claimed in claim 1, wherein a securing ring (8) for axially securing the metal bushing (5) is mounted onto the centrifuge shaft (6).

10. The centrifugal oil separator as claimed in claim 9, wherein the securing ring is a groove nut (23) threaded onto the centrifuge shaft (6).

* * * * *